United States Patent [19]

Gallagher

[11] 3,949,568

[45] Apr. 13, 1976

[54] BOUQUET RING

[76] Inventor: Helen H. Gallagher, 57 Bald Cypress Lane, Levittown, Pa. 19054

[22] Filed: Aug. 9, 1971

[21] Appl. No.: 170,204

[52] U.S. Cl. ..... 63/1 A; 24/5; 47/41.12

[51] Int. Cl.[2] ..... A44C 9/00

[58] Field of Search ..... 63/1, 2; 24/5; 47/41.12

[56] References Cited

UNITED STATES PATENTS

| | | | |
|---|---|---|---|
| 2,787,819 | 4/1957 | Kaber | 24/5 |
| 3,336,697 | 8/1967 | Davis | 47/41.12 |

*Primary Examiner*—F. Barry Shay

*Attorney, Agent, or Firm*—Smith, Harding, Earley & Follmer

[57] ABSTRACT

A bouquet ring for fresh flowers or an artificial nosegay comprising a support base; bendable grasping prongs extending from the support base and adapted to grasp fresh or artificial flowers, a wet or dry synthetic foam-plastic flower support, or a tube-type flower support; a size-adjustable ring band adapted to be placed on a finger; and a rivet connecting the ring band to the support base.

1 Claim, 9 Drawing Figures

INVENTOR
HELEN H. GALLAGHER
BY Smith Harding Earley & Follmer
ATTORNEYS

BOUQUET RING

BACKGROUND OF THE INVENTION

This invention relates to flowers and more particularly concerns a bouquet ring by means of which flowers may be worn on the finger.

Today, corsages are not often worn on ladies dresses because they do not look quite in harmony with today's mode of attire, or quite in keeping with the current fashion trend. Many of the flowers given to young girls as corsages for proms and dances are just carried by hand because the girl cannot think of anything else to do with them. Then they are left at the table while the girl is dancing so that the flowers are not fully enjoyed.

An object of the present invention is to provide means whereby flowers may be worn, instead of just being carried, in such situations.

Another object of the invention is to stimulate the business of the florist by helping the florist regain the business lost by the decline in sales of corsages.

It is another object to provide means whereby the florist's customer will enjoy new and updated expressions of artistry in flowers.

It is another object to provide a bouquet ring that serves the double purpose of supporting fresh flowers for a prom or dance, and thereafter serves as a permanent memento of the occasion. This object is accomplished by providing a special block which is attached to the ring band after the fresh flowers are finished and removed. The block is quite decorative, and may include a minute figure and artificial flowers appropriate to the season.

BRIEF DESCRIPTION OF THE DRAWINGS

Other objects and advantages of this invention, including its simplicity and economy, will further become apparent hereinafter and in the drawings, in which.

DESCRIPTION OF THE PREFERRED EMBODIMENT

Figure 1:
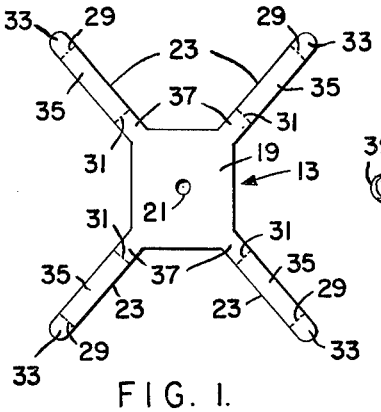
FIG. 1 is a plan view of a support base and grasping prong member which forms an element of the invention.
Figure 2:
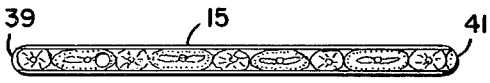
FIG. 2 is a plan view of a decorative ring band before it is rolled into a circle and attached to the element of FIG. 1.
Figure 3:
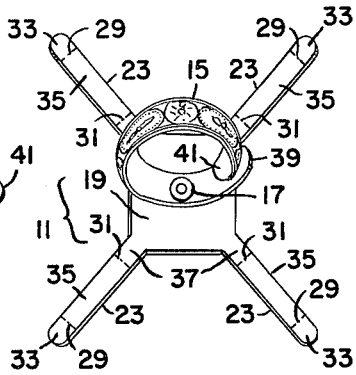
FIG. 3 is a view in perspective of the ring band attached to the element of FIG. 1.
Figure 4:
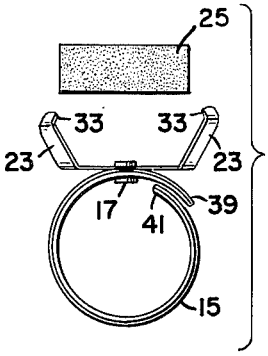
FIG. 4 is a view in elevation showing the base and prong member in the process of being attached to a flower-support block.

Turning now to the embodiments of the invention selected for illustration in the drawings, there is shown a bouquet ring 11 comprising a base and prong member 13 and a decorative ring band 15 connected to base and prong member 13 by a rivet 17.

Base and prong member 13 includes a support base 19 having a hole 21 formed centrally thereof for receiving rivet 17. Bendable grasping prongs 23 extend from support base 19 and are adapted to be bent to grasp fresh or artificial flowers, a synthetic foam-plastic flower support block 25, or a tube-type flower support 27. Prongs 23 may be provided with crease lines 29 and 31 that divide the prongs into tip portions 33, intermediate portions 35 and bottom portions 37.

Ring band 15 is provided with ends 39 and 41 which are bent into overlapping position so as to permit expansion and contraction of the ring band to accommodate fingers of various sizes.

Figure 5:
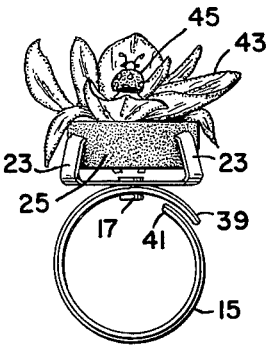
FIG. 5 is a view in elevation showing the bouquet ring in assembled condition.
Figure 6:
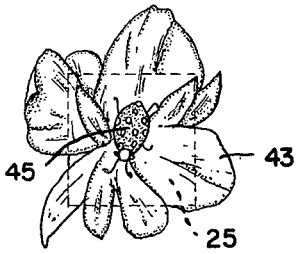
FIG. 6 is a top plan view of the bouquet ring of FIG. 5.
Figure 7:
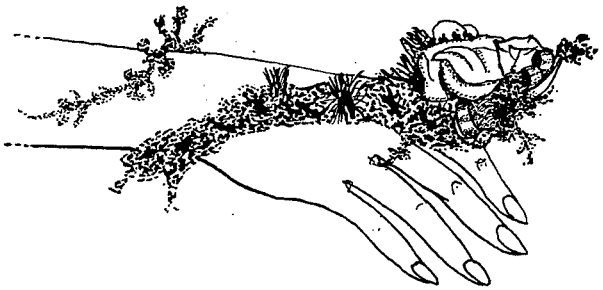
FIG. 7 is a view in perspective illustrating the use of the bouquet ring in position on a finger.

FIGS. 5 and 6 illustrate the use of the bouquet ring 11 as a permanent souvenir, with artificial flowers 43 and a minute decorative beetle 45 being mounted on foam block 25.

Figure 8:
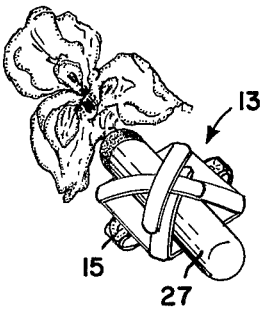
FIG. 8 is a view in perspective showing use of the bouquet ring in supporting a water tube of a fresh flower.
Figure 9:
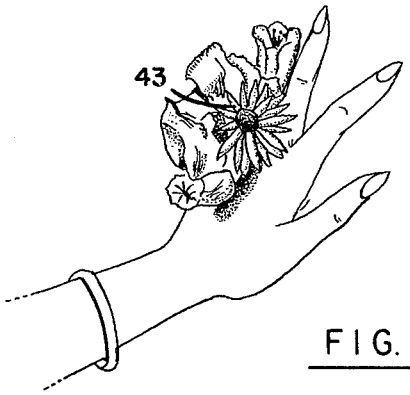
FIG. 9 is a view in perspective showing another use of the bouquet ring.

FIG. 8 demonstrates the use of bouquet ring 11 in holding a water tube 27 with a fresh flower extending therefrom. In FIG. 8, the prongs 23 are bent around tube 27.

If desired, tube 27 may be positioned at an angle away from the finger of the wearer by bending one of the prongs 23 beneath tube 27 instead of around it. This inclined position of the tube is especially adapted for wearing an orchid on the finger. The orchid is kept fresh by the water tube 27, and the inclined position of the tube avoids continual contact of the finger with the orchid, which might damage it. The inclined tube also avoids any awkwardness by the wearer in manipulating her fingers. The orchid tube is supported and braced at any desired angle to show the beauty of the flower, and the orchid corsage is raised above the fingers to allow free movement thereof.

The elongated prongs hold the corsage securely in place as the hand moves during such activities as dancing.

Instead of the decorative beetle illustrated in the drawings, other ornamental devices could be used such as a zodiac figure combined with a flower of the month pertaining to the persons date of birth.

The bouquet ring of this invention is relatively inexpensive, and since it is ornamental as well as useful, it enables the florist to keep costs down by using fewer flowers so that the cost to the customer remains the same as if the florist had used more flowers and less creativity.

It is to be understood that the form of the invention herewith shown and described is to be taken as a presently preferred embodiment. Various changes may be made in the shape, size and arrangement of parts. For example, equivalent elements may be substituted for those illustrated and described herein, parts may be reversed, and certain features of the invention may be utilized independently of the use of other features, all without departing from the spirit or scope of the invention as defined in the subjoined claims.

I claim:

1. A bouquet ring for fresh flowers or an artificial nosegay comprising a support base, bendable grasping prongs extending from said support base and adapted to be bent to grasp fresh or artificial flowers, a wet or dry synthetic foam-plastic flower support block, a flower water tube, and the like; a ring band adapted to be placed on a finger; and connecting means connecting the ring band to the support base; including a synthetic foam plastic flower-support block grasped by said prongs; flowers inserted into and supported by said block; and wherein said ring band is provided with overlapping ends so as to permit expansion and contraction of the ring band to accommodate fingers of various sizes; and wherein said connecting means comprises a rivet joining the ring band to the center of the support base; said support base being wider than said ring band; said prongs including a first pair of prongs extending outwardly from the support base in opposite directions; said prongs also including a second pair of prongs extending outwardly from the support in opposite directions; said prongs further being provided with crease lines that divide the prongs into tip portions, intermediate portions, and bottom portions; with said tip portions being imbedded in the sides of said synthetic foam plastic flower-support block.

* * * * *